United States Patent [19]

Sexton

[11] 3,981,256

[45] Sept. 21, 1976

[54] MAGNETIC AUTOMATIC BOBBIN CHANGER FOR SEWING MACHINES

[75] Inventor: William B. Sexton, Moore, S.C.

[73] Assignee: J. P. Stevens & Co., Inc., New York, N.Y.

[22] Filed: May 9, 1975

[21] Appl. No.: 575,867

[52] U.S. Cl. ..... 112/180

[51] Int. Cl.[2] ..... D05B 57/26

[58] Field of Search ..... 112/180, 181, 186, 196, 112/231; 57/52, 53; 242/41, 46

[56] References Cited

UNITED STATES PATENTS

| | | | |
|---|---|---|---|
| 2,733,676 | 2/1956 | Schumann et al. | 112/180 |
| 3,376,848 | 4/1968 | Schiffmacher et al. | 112/180 X |
| 3,744,442 | 7/1973 | Michaels et al. | 112/186 |
| 3,747,547 | 7/1973 | Mayer et al. | 112/186 |

FOREIGN PATENTS OR APPLICATIONS

| | | | |
|---|---|---|---|
| 221,361 | 4/1910 | Germany | 112/186 |
| 42,171 | 11/1907 | Switzerland | 112/186 |

*Primary Examiner*—Werner H. Schroeder
*Assistant Examiner*—Moshe I. Cohen
*Attorney, Agent, or Firm*—Robert Ames Norton; Michael T. Frimer; Saul Leitner

[57] ABSTRACT

The present invention is an automatic bobbin changer for sewing machines of the lock stitch type having bobbin holders with holder pins and latches. A magazine of full bobbins and cases is positioned adjacent the sewing machine, and a cross slide is provided which is movable from a first position to a second. This slide is provided with two powerful magnets, preferably permanent magnets, which are spaced on the slide so that in one position one magnet is aligned with the sewing machine bobbin holder and the second is aligned with the full bobbin magazine. The two magnets are provided with actuators, preferably fluid operated actuators, which can move the magnets forward so that they contact, respectively, an empty casing in the sewing machine bobbin holder and a full bobbin and casing in the magazine. The two magnets then retract toward the slide and the slide moves to the second position. In the first position the magnet which is aligned with the empty bobbin in the sewing machine first moves forward and contacts the lid of the bobbin case. As it retracts, the lid of the bobbin case is first moved slightly to unlatch it. Above the magnet, which, in the first position of the slide, is opposite the sewing machine bobbin holder, there is provided a stripper plate attached to the slide and positioned to strip the bobbin case off from the magnet as the latter retracts. When the magnets have retracted, the slide is then moved to a second position by another fluid actuated device which brings the second magnet, having the full bobbin and case on its end, opposite the sewing machine bobbin holder, and the two magnets again move forward, pushing the full bobbin onto the sewing machine holder. The magnet is then retracted again toward the slide, leaving the full bobbin and case in the sewing machine bobbin holder. The slide then moves sideways so that the first magnet with its stripper plate is opposite the sewing machine bobbin holder, and the changing cycle is thus completed. The sewing machine starts up and proceeds until the full bobbin is again exhausted. The magazine of full bobbin cases may be of various designs. It may be a sleeve positioned at right angles to the slide with the full bobbins and cases axially aligned and urged forward by suitable spring or it may be of another type of magazine which brings sequentially full bobbins and cases opposite the magnet.

7 Claims, 3 Drawing Figures

Fig. 3.
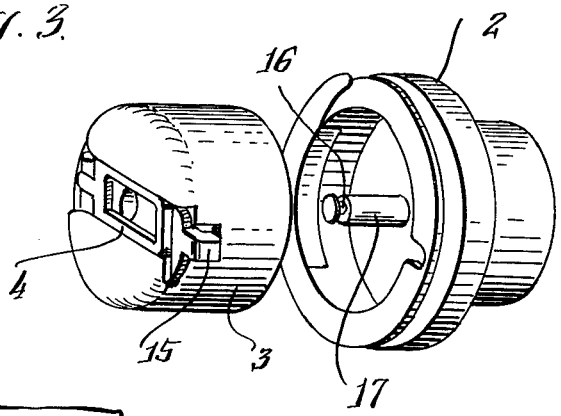
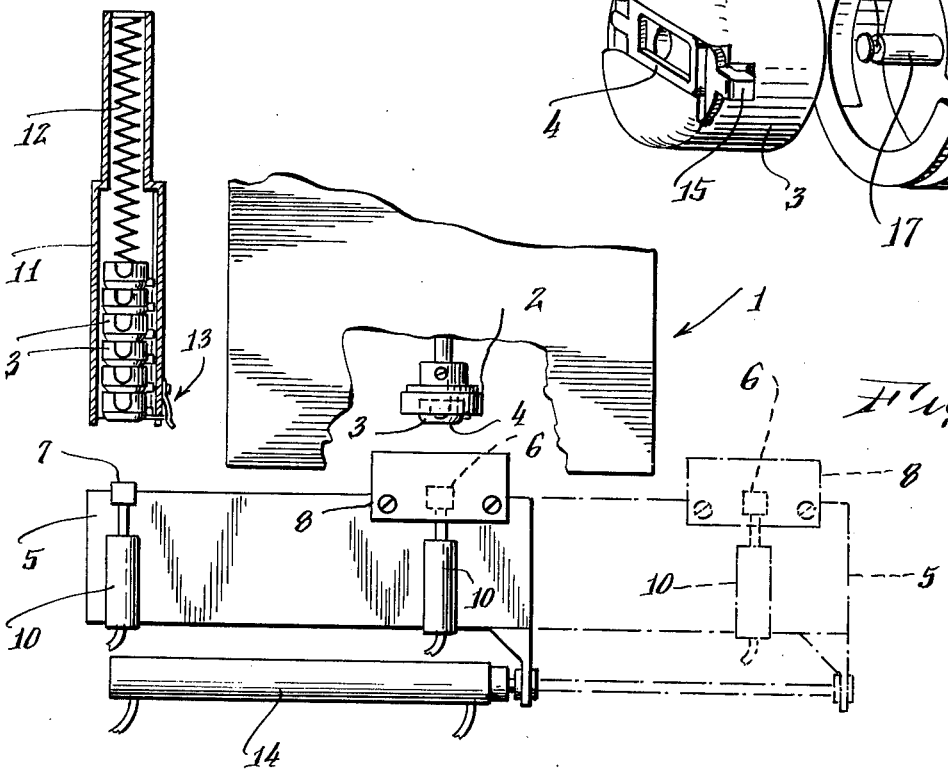
Fig. 1.
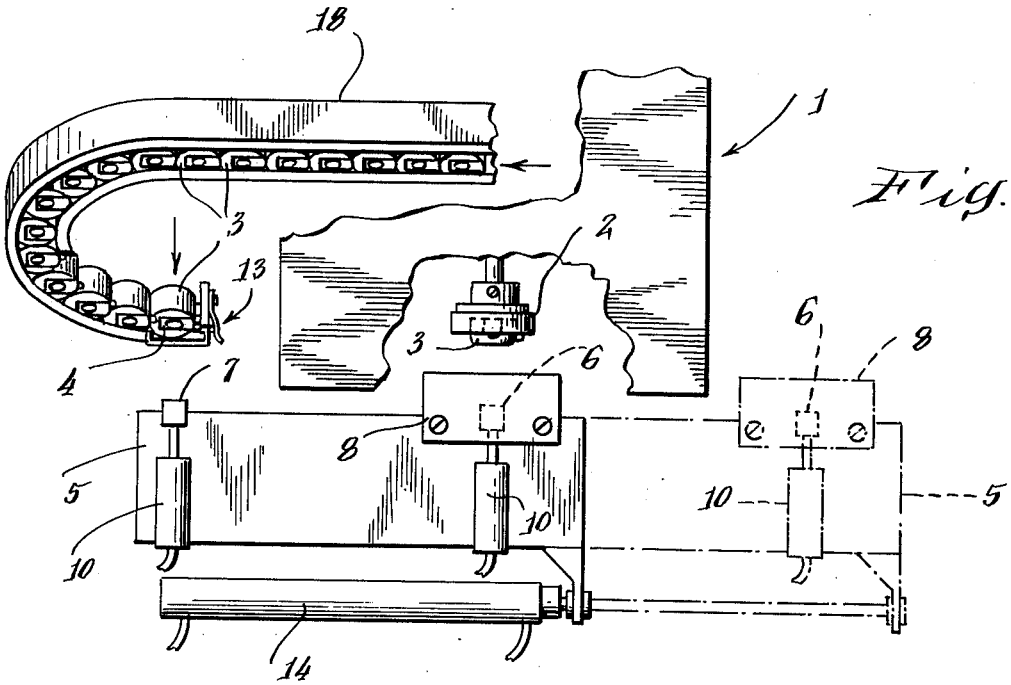
Fig. 2.

MAGNETIC AUTOMATIC BOBBIN CHANGER FOR SEWING MACHINES

BACKGROUND OF THE INVENTION

In industrial sewing machines of the lock stitch type which require bobbins and which operate at high speeds consuming a large amount of thread on the bobbin, the problem presented by changing bobbins is a serious economic one. The sewing machine is normally only one part of a sequence of machinery which for many operations is extremely expensive, and stoppage of the sewing machine and hence interruption of the whole operation in order to change bobbins represents a serious cost for the down time during bobbin change.

Originally sewing machine bobbins were changed by hand, which is a slow operation and requires both considerable additional labor and cost for the down time of an expensive organization of machinery.

In the past automatic bobbin changers for industrial sewing machines have been built and used. These changers grasp an empty bobbin with a hook, requiring several elements for actuation. The hook first catches the lid of the bobbin case and opens it and, finally as it retracts further, pulls the empty bobbin and case out, which then drop into a suitable container. The mechanism, including the hook, is usually mounted on a cross slide and can be moved to a second position aligned with a magazine of full bobbins and cases. In this position it is actually removing a full bobbin and case to a suitable carrier housing or other element on the slide. The slide then moves back to its first position and the hook moves forward, pressing the full bobbin and case onto the conventional latch, usually a pin, which holds a full bobbin in the sewing machine during operation. Since the hook is pushing, it does not open the lid and is then retracted onto the slide, permitting the cycle to be repeated when the conventional sensor on the sewing machine indicates that the replaced bobbin is practicallly empty. Actuation of the elements moving the hook and of the slide may be pneumatic or hydraulic or may be electrical.

A typical illustration of the automatic bobbin changer described above is to be found in the Schiffmacher and Roman U.S Pat. 3,376,838, Apr. 9, 1968. It will be noted that there is only a single mechanism including the hook and that the cross slide is provided with a suitable carrier housing or other elements for carrying a full bobbin and case from a magazine on the next cycle.

While automatic bobbin changers greatly speeded up bobbin changing as compared to manual changing and are quite generally used on industrial sewing machines, this saving in time is achieved only at the cost of a serious problem. The hook which has been described can jam the case latch, which of course then requires stopping the changing mechanism and freeing the jammed bobbin case from the hook manually. This operation takes some time, and in the meantime the sewing machine and any related machinery which is synchronized with the sewing operation stops. This results in down time with markedly increased costs. The automatic bobbin changing machines which have been used and which are described above do not jam every time they change bobbins but this happens sufficiently frequently to present a serious problem. In other words, the automatic bobbin changers which have been used in the past are not inoperative when a bobbin case does not jam as the lid is grasped by the hook, but the problem still remains and leaves room for improvement. It is with an improved automatic bobbin changer of quite different structure, which cannot jam, that the present invention deals.

SUMMARY OF THE INVENTION

The present invention retains all of the advantages of automatic bobbin changers and overcomes the drawbacks which have been referred to above. Instead of providing a single hook with associated actuating mechanism of some complexity, there is used a slide with two magnets and actuating means to cause them to move forward and then retract. Ths slide does not require any housing or other carrier mechanism to move full bobbins and cases from a magazine to a point in alignment with the bobbin holder in the sewing machine. The two magnets perform all of the functions of the known automatic bobbin changer while eliminating many elements and, as will be described below, result in improved and more rapid operation as they are completely jam-proof.

The cross slide on which the two magnets are mounted, together, of course, with their actuating mechanisms, which are preferably operated by fluid, such as compressed air, starts in a position with one of the two magnets aligned with the sewing machine bobbin holder and the other in a position where it can remove a full bobbin and case from the magazine.

When the conventional sensor on the sewing machine senses that a bobbin is practically empty, it actuates a sequence of operations of the automatic changer with the two magnets, as will be described. In the first position the first operation is to move both magnets forward, i.e., toward the sewing machine. The magnet which is aligned with the sewing machine bobbin holder first encounters the lid of the empty bobbin case and is held thereto by its strong magnetism. At the same time, the second magnet moves forward, encountering the end of a full bobbin and case in the magazine. The next operation causes both magnets to be retracted onto the slide. The magnet holding the lid of the empty bobbin case in the sewing machine bobbin holder is first moved a short distance, which opens the lid, and then on further movement the empty case and bobbin is withdrawn from the sewing machine bobbin holder. Stripping means are provided, such as a stripping plate attached to the slide above the magnet, and this strips the empty bobbin and case from the end of the magnet, where they are dropped into a suitable container or chute, which need not be essentially any different from the corresponding container on known automatic bobbin changers. The second magnet, which is opposite the magazine carrying full bobbins and cases, removes a full case and holds it. As the cases are held in the magazine only by a relatively weak detent as opposed to the strong latching means on the conventional sewing maching bobbin cooperating with the holder, the full bobbin and magazine are removed without opening the casing lid, by its latching lever. If desired, this second magnet may have less strong magnetism than the first magnet but has to have sufficient strength to hold the full bobbin and case through the following operations.

The next operation moves the cross slide, bringing the second magnet carrying its full bobbin and case opposite the sewing machine bobbin holder. Then the magnets are moved forward, pushing the full bobbin and case onto the sewing machine bobbin holder, where it is relatively firmly latched. Now when the magnets are retracted the second magnet does not remove the full bobbin and case from the sewing machine bobbin holder. The next operation, which can occur immediately, is to move the cross slide back into the first position, where the first magnet is opposite the sewing machine bobbin holder and the second opposite the full bobbin magazine. This is the position which has been described as the starting position for the bobbin changing, and now the sewing machine can be started up manually or automatically. The sewing machine continues to operate until the full bobbin is again almost exhausted, whereupon the conventional sensor starts the changing operation which has been described.

It should be noted that the magnets cannot jam an empty bobbin case lid and latching lever, which happens otherwise from time to time, as has been described above. The two magnets perform the functions of bobbin changing and of carrying a full bobbin from the magazine to the sewing machine bobbin carrier without additional mechanism except, of course, for the movement of the slide from the first position to the second. Since the magnets of the present invention cannot cause jamming, it is possible to speed up the time for automatic bobbin changing because, of course, where a hook is used the operation must be sufficiently slow so that jamming of the empty bobbin case lid will not occur too frequently. This effects an additional saving because it reduces the time during automatic bobbin change when the sewing machine is not operating, and this is an additional advantage of the present invention over and above the important one of being jam proof.

The actuating mechanisms, usually fluid cylinder and piston, for the two magnets are extremely simple, require a smaller number of elements than is needed with the hook, which has to be both moved forward and retracted and also swung to grasp the lid latching lever when removing an empty bobbin. The saving in the number of elements, even though two magnets are used instead of a single hook, reduces cost and improves reliability, an additional practical advantage. In other words, the jam-proof changers of the present invention with their two magnets on a slide and no carrier housing obtain all the advantages without any accompanying drawbacks.

The present invention has the additional advantage that a number of pieces of equipment which are needed on the sewing machines for automatic bobbin changing can be used. For example, the sensor on the sewing machine is not changed at all by the present invention, control of actuating means is simple, usually electrical, and requires no new special technique as opposed to the ordinary automatic bobbin changers. Since the present invention does not change many of these elements which have been used before, the conventional elements are not shown on the drawings, which are, therefore, to be considered as semi-diagrammatic.

In the drawings there will be shown two variants of magazines, one which axially aligns the full bobbins and cases and which is essentially similar to that shown in the Schiffmacher and Roman patent, and a second variant in which the magazine does not contain aligned bobbins and bobbin cases. These are two illustrations of suitable magazines but the invention is not limited thereto and any magazine may be used which is capable of presenting sequentially full bobbins and cases to the magnet.

BRIEF DESCRIPTION OF THE DRAWINGS

FIG. 1 is a diagrammatic plan view looking down on the movable slide and with a portion of the sewing machine above the bobbin holder broken away, the rest of the sewing machine also being broken away and not illustrated;

FIG. 2 is an illustration of a different full bobbin and casing magazine which does not carry the bobbins and cases axially aligned at right angles to the movement of the slide, and FIG. 3 is an exploded view of a conventional bobbin case and its cooperating portion of the sewing machine bobbin holder.

DESCRIPTION OF THE PREFERRED EMBODIMENT

Turning to FIG. 1, the portion of the sewing machine shown is at 1 with a bobbin holder 2, technically known as a "sewing hook," in which a bobbin and bobbin case 3 is held. The portion of the sewing machine base over the bobbin holder is broken away. The bobbin carrier case 3 is provided with the conventional lid and latching lever 4. The bobbin itself is not visible as it is not necessary to illustrate it since it is a conventional element.

While it is a conventional piece of equipment, the bobbin case and the cooperating portion of the sewing machine bobbin holder is shown in an enlarged exploded view in FIG. 3. On top of the lid the latching lever 4 actuates a latch 15, which, when the bobbin and bobbin case are on the sewing machine, latches into the deep groove 16 on the bobbin holder pin 17. Of course, the bobbin itself slides onto the pin 17 when in the holder, but as this part of the mechanism is not changed by the present invention the drawings do not show the bobbin itself, which would otherwise have to be shown in phantom and could confuse the drawings.

A cross slide 5 is shown in FIGS. 1 and 2 which moves across the sewing machine base on suitable tracks, (not shown). the slide 5 is shown in two positions, a first position which is the position at the start of a changing cycle and is shown in full lines, and a second position for the completion of the cycle in which the slide is shown in dashed lines. The slide is provided with two permanent magnets 6 and 7, the former being below a stripper plate 8 attached to the slide, the operation of which will be described further below.

Each magnet is actuated from a source of compressed air through two flexible tubes, a portion of which only is shown. The controls for the air pressure in the cylinder to effect the sequence of operations which will be described below are not illustrated as any conventional means can be used, for example, electrically operated solenoid means. The particular design of the control is not changed, or need not be, by the present invention and is not the feature distinguishing the invention from the prior art.

Magnet 7 in the position illustrated in full lines is opposite a magazine 11 carrying a series of bobbins in their cases axially aligned and urged forward by a spring 12. The bobbins and bobbin cases bear the same numerals as the empty bobbin case in the sewing machine bobbin holder which has just been described.

When the cylinders 10 receive compressed air and move the magnets 6 and 7 forward, each magnet encounters the lid and latching lever 4 of the two bobbin cases, one the empty one in the sewing machine holder and the other the full one at the end of the magazine. When the controls then cause the actuating cylinders 10 to retract the magnets 6 and 7 the empty and full bobbins and bobbin cases attach themselves to the magnets and are pulled back toward the slide. Since there is no strong latch in the magazine but only a very light detent 13, the bobbin case removed by the magnet 7 does not have the latching lever 4 opened. In other words, this bobbin and case moves as a whole. In the case of the empty bobbin on the sewing machine bobbin holder in the sewing machine, the much stronger conventional latching means for a bobbin holder, which is shown in detail in FIG. 3, holds the casing with sufficient force so that the first movement on retraction of the magnet 6 which can, if desired, be stronger than magnet 7, lifts the lid latching lever 4. The lever moves the latch 15, retracting it from the groove 16. The magnet then pulls the empty bobbin with its opened case back. As the case strikes the edge of the stripper plate 8, FIGS. 1 and 2, it is stripped off the magnet, and since the case has been opened as the magnet 6 started to retract, bobbin case and empty bobbin drop out into a suitable container or chute, which is not shown as it is not changed by the present invention.

When the operations just described have been completed, air cylinder 14 is then actuated and moves the cross slide 5 to the position shown in dashed lines, which brings the magnet 7 carrying the full bobbin and casing which it has removed from the magazine 11 with it opposite the sewing machine bobbin holder 2. The magnet 7 is then in the position occupied by the magnet 6 in the first position in full lines. The bobbin and bobbin case which it carries are not shown in phantom as this could only confuse the drawing since it would appear as if this were in the first position whereas, of course, there is no striker plate 8 above magnet 7. Now when the cylinders 10 move the magnets 6 and 7 forward, the full bobbin and case is pushed forward into the bobbin holder 2 in the sewing machine until it latches onto the sewing machine bobbin holder latching mechanism, which, as shown in FIG. 3, is an ordinary conventional center pin 17 with a deep groove 16 into which the latch 15 snaps. This part of the machine is not changed by the present invention. The magnets are then withdrawn and the slide is moved by the air cylinder 14 to the position shown in solid lines. This completes the changing cycle, the sewing machine is again started manually or automatically, and proceeds until the fresh full bobbin is nearly exhausted, at which time the cycle described above is repeated.

It will be noted that there is no hook, and when the magnet 6 removes the empty bobbin case from the sewing machine it cannot catch in the lever 4 and jam it because the magnet is always pulled straight back and is held against th case only by magnetism. As a result, jamming is impossible and any delays or down time resulting from occasional jamming are eliminated. At the same time because the magnetic pull is perfectly straight and there can be no jamming by a hook, a more rapid changing cycle is possible, which further reduces down time and is the second economic advantage of the present invention. It should be noted that the savings in down time are achieved without any drawbacks. While there are two magnets instead of a single hook, the mechanisms moving the magnets are simpler and cheaper than the pivoted plates and hooks of known changers, and so the actual cost of the changes is no greater and usually somewhat less. Looking at it from another angle, the pivoting hooks require several elements which are eliminated by the present invention but their function is not eliminated.

FIG. 2 illustrates a somewhat different design of full bobbin and case magazine. The mechanism for changing bobbins is exactly the same as that shown in FIG. 1, and therefore the same reference numerals are used. Instead of a cylindrical magazine axially aligned with the position of magnet 7 in FIG. 1, a curved magazine 18 carries the full bobbin cases by gravity to a point opposite the magnet 7 where the bobbin and bobbin case is held by a detent 13, which operates in substantially the same manner as detent 13 in FIG. 1. Instead of a spring to move the full bobbins to the position where the magnet 7 can pick them up one by one, gravity is used, although, of course, if desired, a spring can be provided, which is not shown as the end of the magazine is broken away in FIG. 2. Although there is no alignment of the bobbins in the magazine 18 with the magnet 7, they are sequentially moved so that the bobbin to be picked up by the magnet is directly opposite it.

FIGS. 1 and 2 illustrate two shapes and designs of full bobbin magazines. The invention, of course, is not limited to these two shapes of magazines and any suitable magazine which will permit a bobbin to be moved directly opposite the magnet 7 may be used. In other words, the present invention is not concerned with the particular design or details of construction of the full bobbin magazine except that the magazine must be so positioned tha a bobbin will be presented opposite the magnet 7 where it can be picked up in the operation as has been described above.

I claim:

1. In a lock stitch sewing machine and automatic bobbin changer, the sewing machine being provided with a conventional bobbin holder adapted to hold a bobbin and case, the case having a latch and means for holding the bobbin and case and strong detent means for holding the bobbin and case, said detent means cooperating with the latch, a sensor on the sewing machine for sensing when a bobbin is almost exhausted, said sensing means providing a signal when the approaching exhaustion of the bobbin actuates the sensor, the improvement, comprising, in combination, a. a magazine positioned adjacent to the sewing machine adapted to hold a plurality of bobbins and cases and quick detent means, b. a cross slide provided with a first magnet and a second magnet and actuating means for moving the magnets toward and away from the sewing machine and magazine and also actuating means for moving the slide from a first position in which the first magnet is opposite the sewing machine bobbin holder and the second magnet is opposite the magazine, c. initiating means for the magnet and slide actuating means, said initiating means being actuated by the signal from the almost-empty bobbin holder sensor, the initiating means causing the magnet actuating means to move the first magnet toward the bobbin holder and the second magnet toward the magazine, the movement being sufficient to contact the magnets with an almost empty bobbin and case on the sewing machine and with a full bobbin and case in the magazine, d. means for actuating the magnet moving means through a cycle after the magnets are moved toward the sewing machine and magazine by the initiating signal means, said cycle first withdrawing the magnets, the first magnet being sufficiently strong to move the latch to an unlatched position whereby the unlatched empty bobbin and case is removed from the sewing machine bobbin and case holder and the full bobbin and case is removed from the magazine, the second step in the cycle actuating the means for moving the slide to a position in which the magnet and full bobbin case are aligned with the sewing machine bobbin and case holder, the second step of the cycle moving the second magnet forward a sufficient distance to lock the full bobbin and case in the bobbin holder by means of the latch and the detent mechanism, the third step in the cycle retracting the second magnet, said magnet being insufficiently strong to unlatch the full bobbin and case, the fourth step in the cycle actuating the slide to move to the position where the first magnet is aligned with the sewing machine bobbin holder and the second magnet with the magazine.

2. A lock stitch sewing machine and automatic bobbin changer according to claim 1 in which the cross slide has affixed thereto a stripping plate positioned over the first magnet, whereby when the first magnet retracts with the empty bobbin and case they are stripped off by the plate.

3. A lock stitch sewing machine and automatic bobbin changer according to claim 2 in which the full bobbin and bobbin case magazine holds the full bobbins and cases out of axial alignment but permits presentation sequentially of a full bobbin and case to the second magnet when the latter moves forward in the first operation of the changer sequence.

4. A lock stitch sewing machine and automatic bobbin changer according to claim 2 in which the full bobbin and carrier magazine is a cylinder at right angles to the cross slide carrying the full bobbins and cases in axial alignment and provided with spring and detent means to urge the full bobbins sequentially into contact with the second magnet as it moves forward in the first operation of the changer sequence.

5. A lock stitch sewing machine and automatic bobbin changer according to claim 1 in which th movements of the magnets and of the cross slide are by pneumatic cylinders.

6. A lock stitch sewing machine and automatic bobbin changer according to claim 2 in which the movements of the magnets and of the cross slide are by pneumatic cylinders.

7. A lock stitch sewing machine and automatic bobbin changer according to claim 4 in which the movements of the magnets and of the cross slide are by pneumatic cylinders.

* * * * *